United States Patent [19]

Weber

[11] 4,336,464

[45] Jun. 22, 1982

[54] TWO TERMINAL TIMED ELECTRIC SWITCH PROVIDING ZERO OFF-STATE CURRENT FLOW THERETHROUGH

[76] Inventor: Harold J. Weber, 20 Whitney Dr., Sherborn, Mass. 01770

[21] Appl. No.: 37,822

[22] Filed: May 10, 1979

[51] Int. Cl.[3] ..... H01H 7/00

[52] U.S. Cl. ..... 307/141.4; 340/309.1; 315/360

[58] Field of Search ..... 307/141, 141.4; 315/360; 340/309.1; 328/77

[56] References Cited

U.S. PATENT DOCUMENTS

| | | | |
|---|---|---|---|
| 2,984,755 | 5/1961 | Anastasia | 307/141.4 |
| 3,939,361 | 2/1976 | Aidala | 307/141 |
| 3,940,660 | 2/1976 | Edwards | 307/141 |
| 3,979,601 | 9/1976 | Franklin | 307/141 |
| 4,002,925 | 1/1977 | Monahan | 307/141 |
| 4,096,542 | 6/1978 | Pappas | 307/141 |
| 4,151,515 | 4/1979 | Pease | 340/309.1 |

*Primary Examiner*—L. T. Hix

*Assistant Examiner*—S. D. Schreyer

[57] ABSTRACT

A two terminal timed electric switch which connects in series with but one side of a power carrying a.c. circuit. In particular the timer serves as an effective replacement for the ubiquitous wall-switch type of on and off device used in the construction trades, as in houses, business buildings, and the like. An advantage is that when used as a replacement for an ordinary switch, the timer serves to achieve significant energy savings by turning forgotten lights off when not needed. The timer functions as a delayed-off switch; that is to say the switch and the load are turned on by manual actuation, but turn-off does not occur until some finite time period has elapsed. The timed switch employs all electronic timing elements, e.g. no motors or thermal timing elements or the like. The principal power for operation of the circuits attendant to the timer is obtained by the substantial current flow between the source and the load when the load is "on" and therefore has no necessitous adjoinment with but one side of a power carrying circuit.

18 Claims, 17 Drawing Figures

Delayed "OFF" Light Fixture Hookup

TYPICAL WAVEFORMS ASSOCIATED WITH FIG. 3

TYPICAL WAVEFORMS ASSOCIATED WITH FIG. 9

Figure 1:
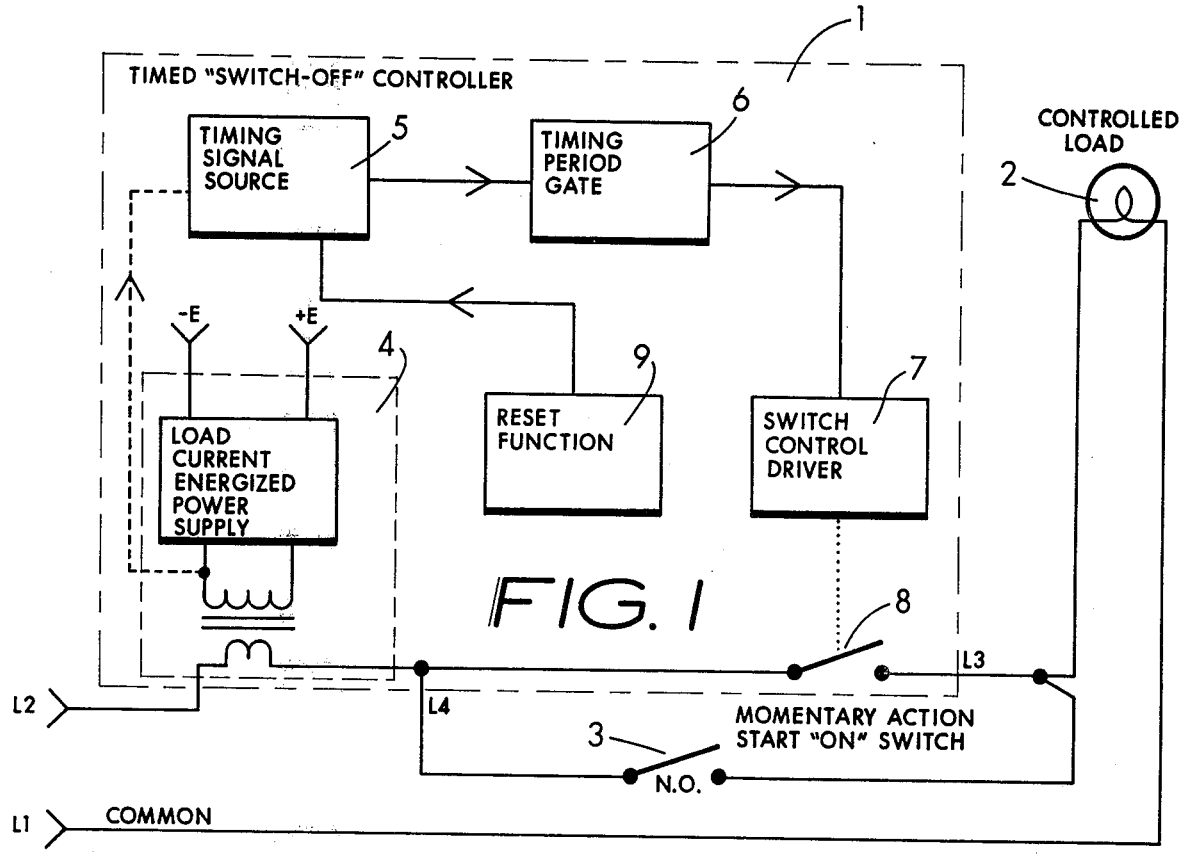

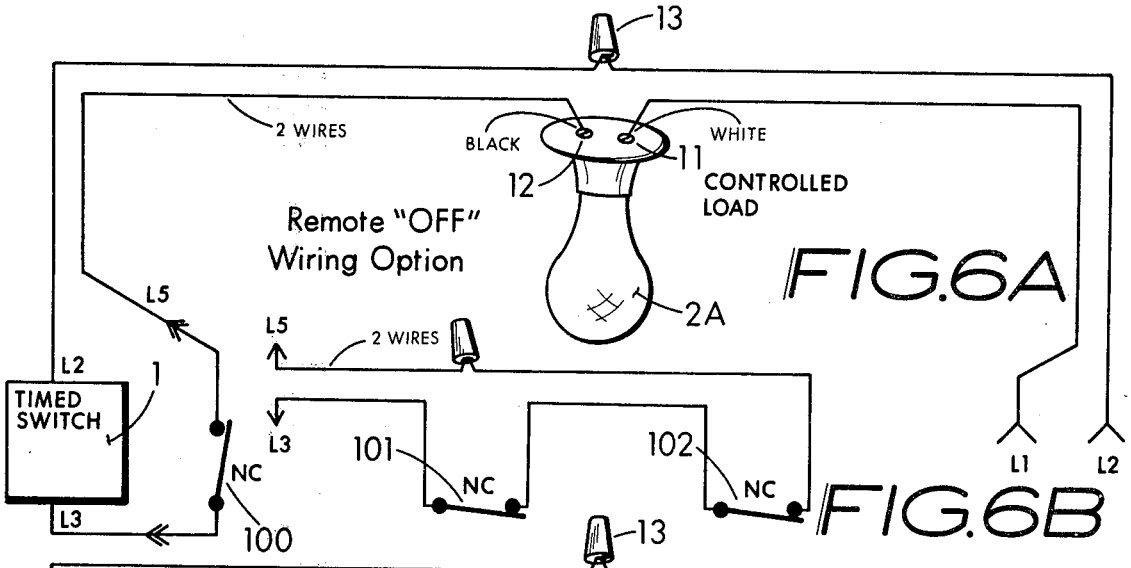
FIG.6A
FIG.6B
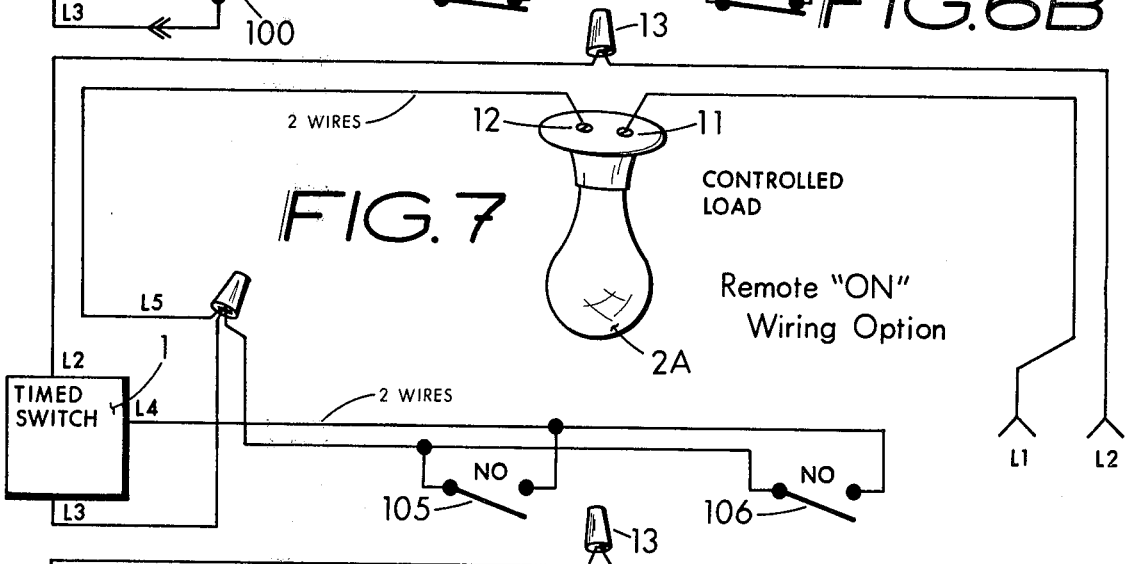
FIG. 7
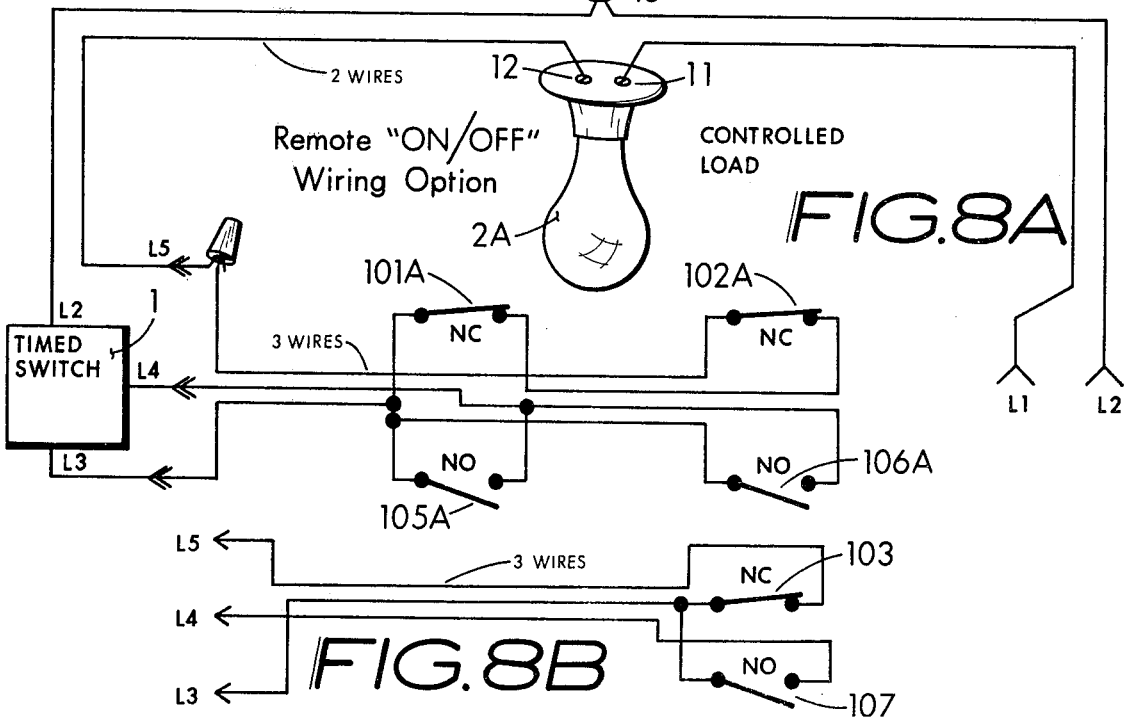
FIG.8A
FIG.8B

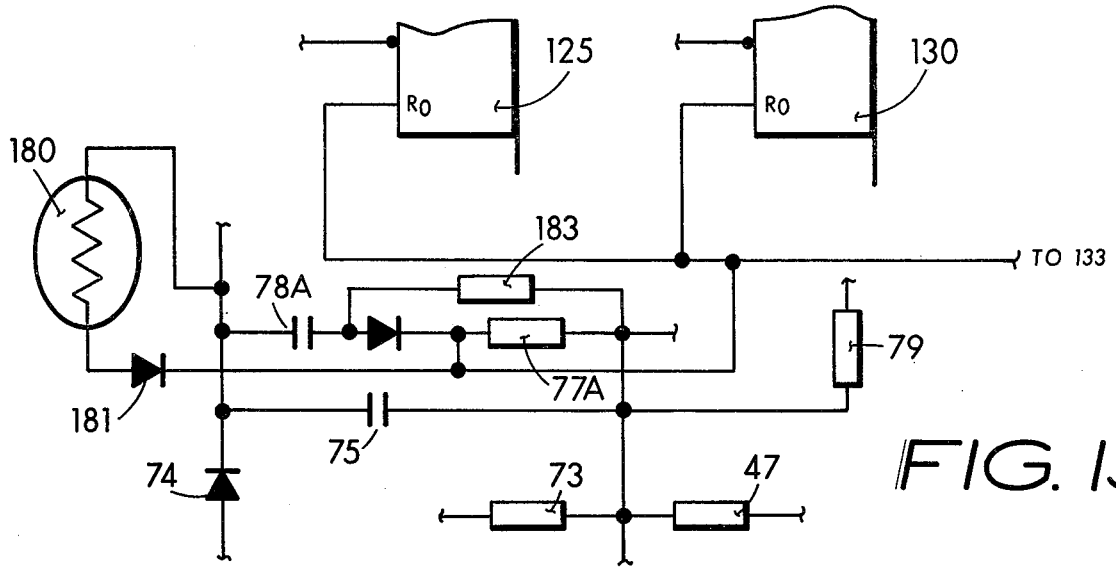
FIG. 13
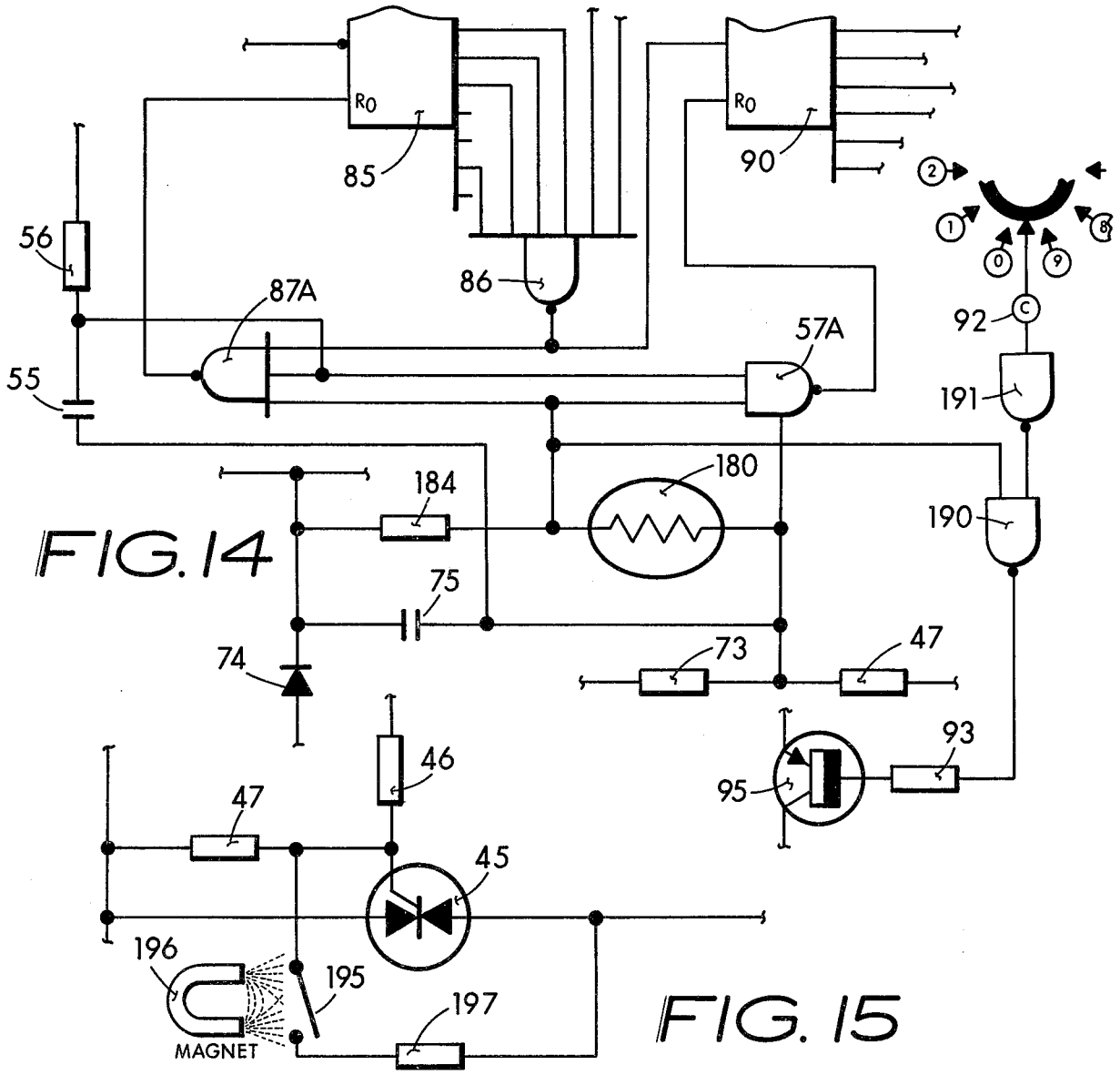
FIG. 14
FIG. 15

TWO TERMINAL TIMED ELECTRIC SWITCH PROVIDING ZERO OFF-STATE CURRENT FLOW THERETHROUGH

SUMMARY

The invention describes a two terminal timed switch which, in one form, can provide a ready replacement or substitute for the ordinary electric wall switch as used by the building trades. The use of a timed switch can save much energy through the effectual shut-off of forgotten switches, or the delayed turn-off or turn-on of hallway lights, garage lights, and the like.

Switches providing time delayed action are known which use thermal elements, mechanical motors, pneumatic devices, and the like which connect only in one side of a load circuit. Electric timed switches are also known which couple in but one side of a load circuit, drawing power for the operation thereof through the load even when the load circuit provided by the timed switch is in the "off" state. This invention describes a significant improvement in that all-electronic timing and control circuit elements are employed which afford better reliability, excellent precision, environmental resistance, and low-cost manufacture, while drawing no current through the load when in the "off" state. Known electronic timing elements can be had which require connection to both sides of the electric circuit, i.e. three terminal: input, output, and common. In-so-far as is known, this invention teaches the first truely two terminal electronic timer, i.e. input and output only, no common required; and which draw no current through the load for the sustained operation thereof when the load is in the timed "off" state. The advantage of this is that no hazardous electric potential is present at the load during the off state in the new invention, whereas the substantial finite current in the earlier timers during the "off" state can induce injury into a workman or other unsuspecting user when servicing a circuit containing one of the earlier class of electronic timers. The advantage afforded by this is that of safe installation, especially in old construction. This is beneficially significant for the acceptance of the invention by building inspectors and other safety experts or the like as a widely applicable energy saving device because the most ordinary S.P.S.T. wall switch, popular for the control of lights and the like in homes as well as business, requires but two wires for satisfactory operation. As a result and for the sake of economy, usual trade practice is to run a single length of so-called Romex, or two wire type NM cable, between a light fixture and a wall mounted toggle switch. This practice of course affords no third wire option, e.g. common, at the switch location therefore limiting the choice of a timed switch to that of one of the two-terminal mechanical varieties prior to my invention if a safe state of no current flow was required during the load timed "off" state. This teaching unfolds a vast improvement for this class of application, as now the better performing electronic timing techniques can be practically used with but a two terminal connection. This is accomplished by deriving the functional electric voltage values required for satisfactory semiconductor circuit operation by way of utilizing the current flow between the source and the load, through but one circuit leg, to produce the necessary functional voltage values. The invention is further described to usually provide a delayed-off function. Remote control and over-ride circuit modes are depicted, giving good exhibit of the flexability of the invention's essence. Time delays from that of but a few seconds to that of hours, days, or even longer can be provided by variant implementations of the instant teachings. The absolute precision of the delay, while not usually of great import in building related applications, is inherent in that some part of the delay cycle is derived from a constant frequency source. This means of time determination does provide more reliable and predictable service, particularly in seldomly actuated applications and for use in environmentally hostile locations.

DESCRIPTION OF DRAWING FIGURES

Eight sheets of drawings providing seventeen figures exhibit the teachings of this invention as:

FIG. 1 Functional diagram showing the interrelationship of the several essential elements comprising the timed switch.

Figure 2:
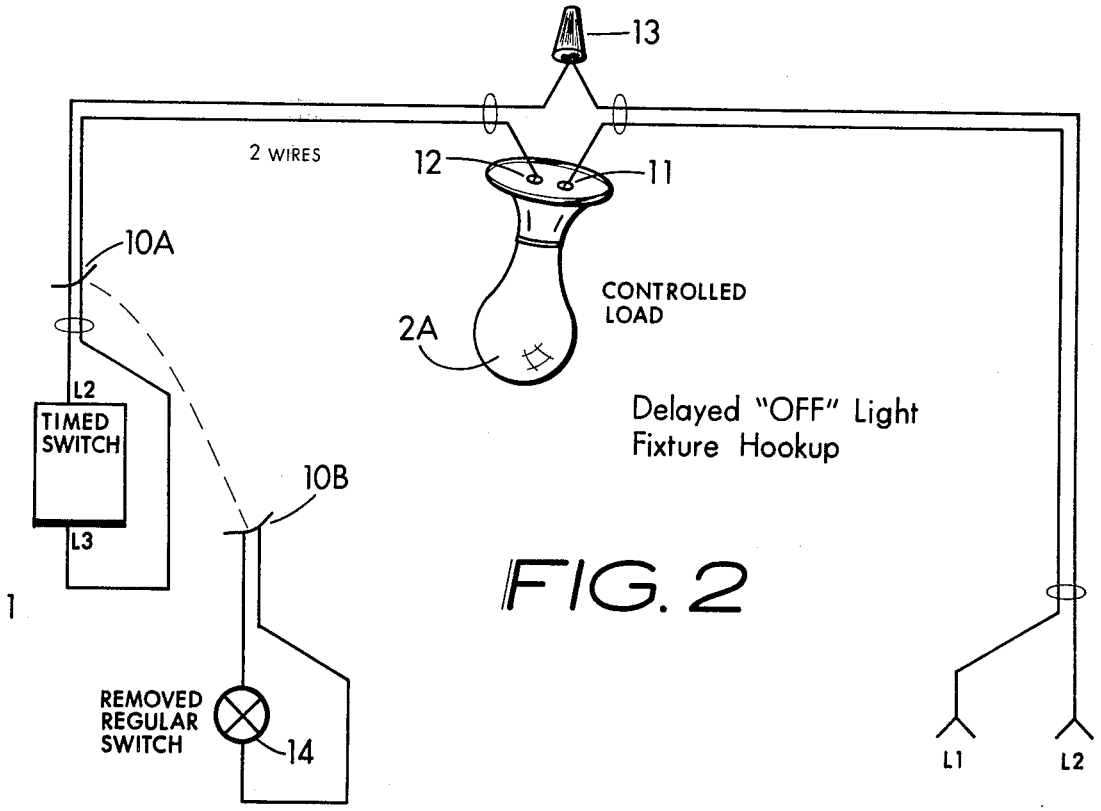

FIG. 2 Wiring diagram showing the timed switch as a replacement for an ordinary wall switch or the like.

Figure 3:
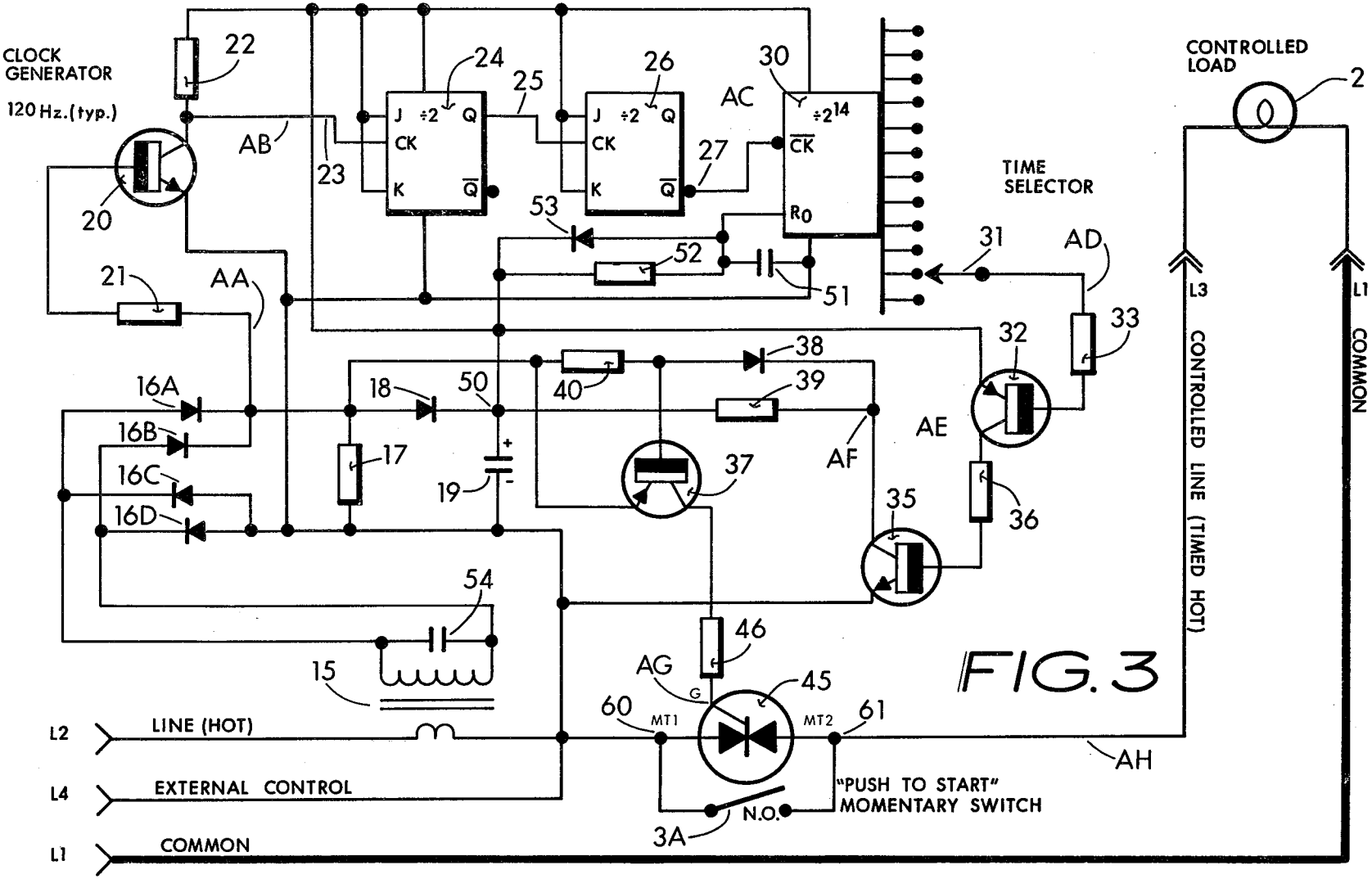

FIG. 3 Circuit diagram for one embodiment of the teaching providing a delayed OFF function after the circuit is turned on and having binary time increments.

Figure 4:
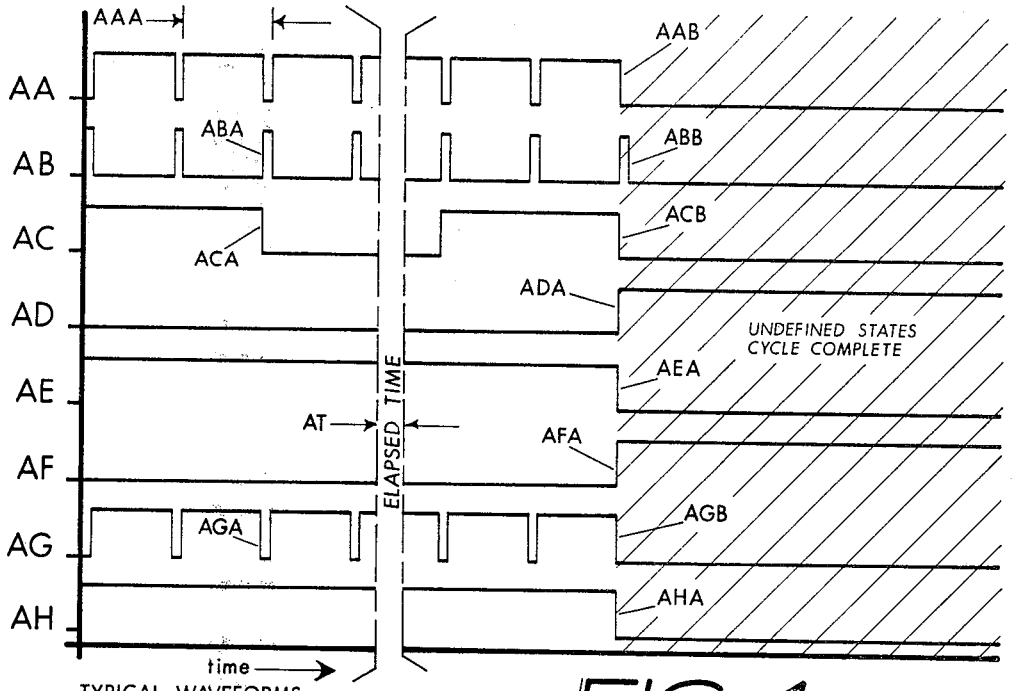

FIG. 4 Waveform representations for the circuit described in FIG. 3.

Figure 5:
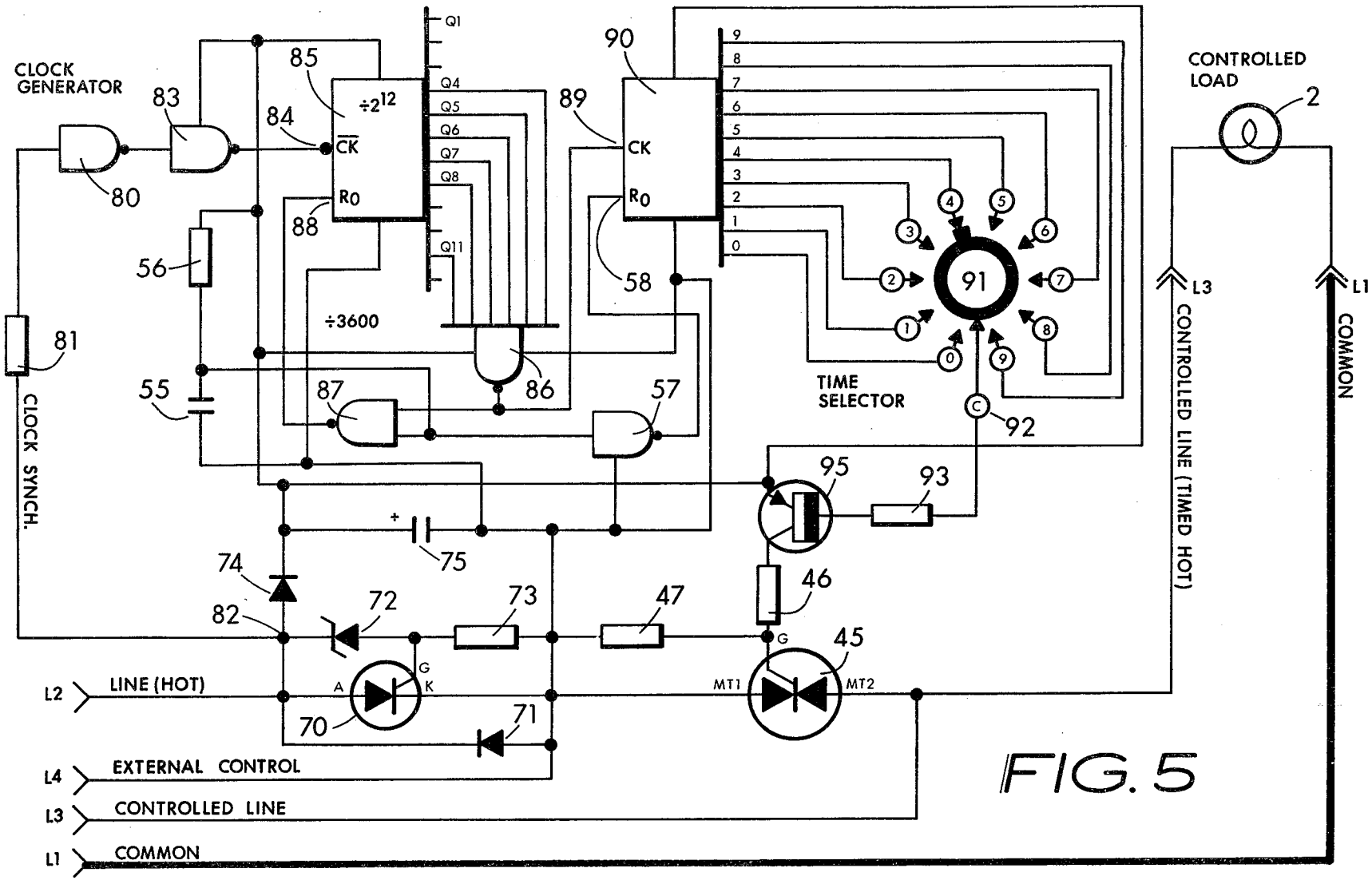

FIg. 5 Circuit diagram for one embodiment of the teaching providing a delayed OFF function after the circuit is turned on and further showing decimal time increments and a solid state d.c. power supply.

FIG. 6A Hookup showing the use of a remote OFF control station for the switch.

FIG. 6B Hookup variation for FIG. 6A showing plural control stations.

FIG. 7 Hookup showing the use of remote ON control stations for the switch.

FIG. 8A Hookup showing the use of remote ON and OFF control stations for the switch.

FIG. 8B Hookup variation for FIG. 8A showing but a single control station.

Figure 9:
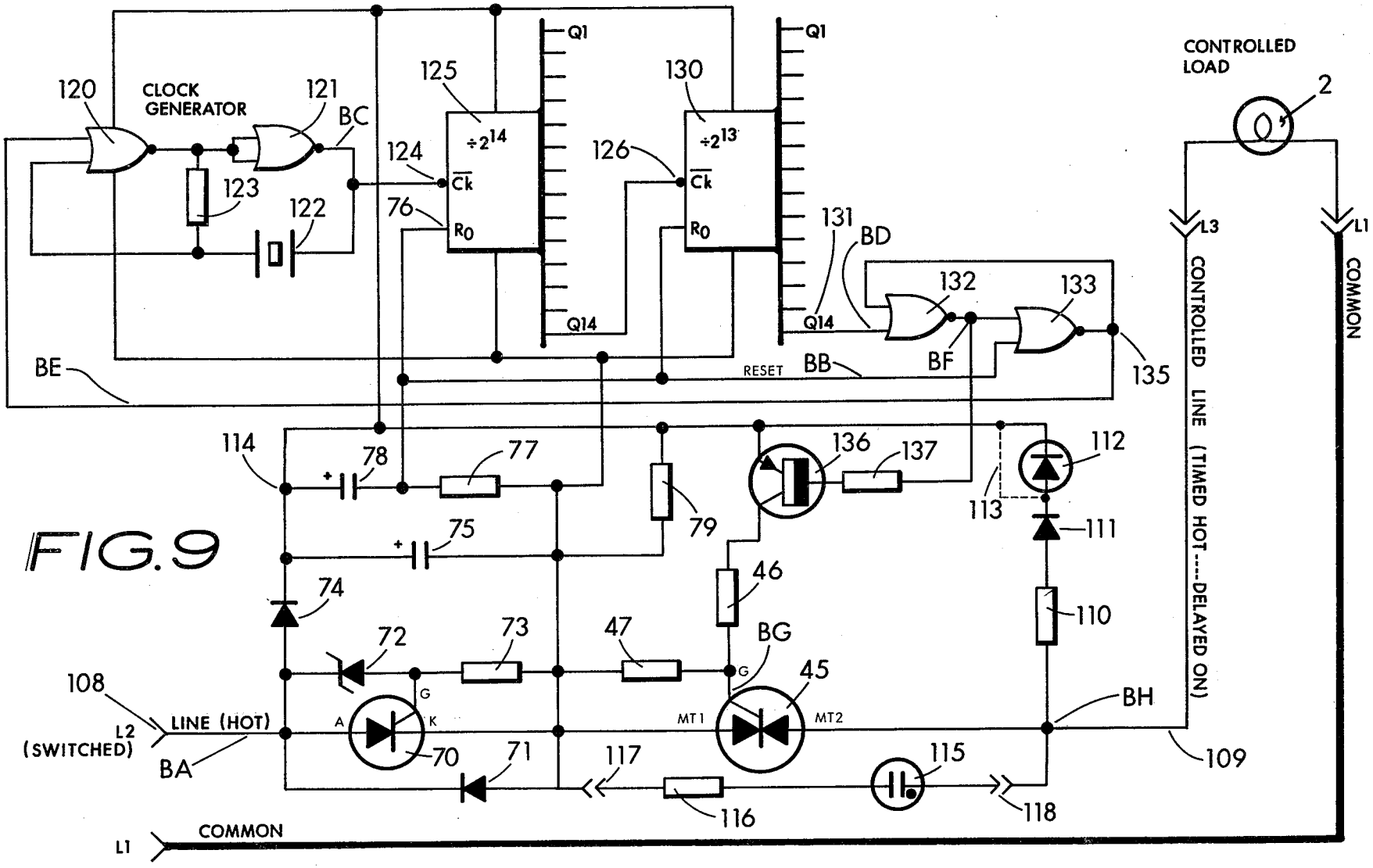

FIG. 9 Circuit diagram for one embodiment of the teaching providing a delayed ON function after circuit energization and further showing a local time base clock source.

Figure 10:
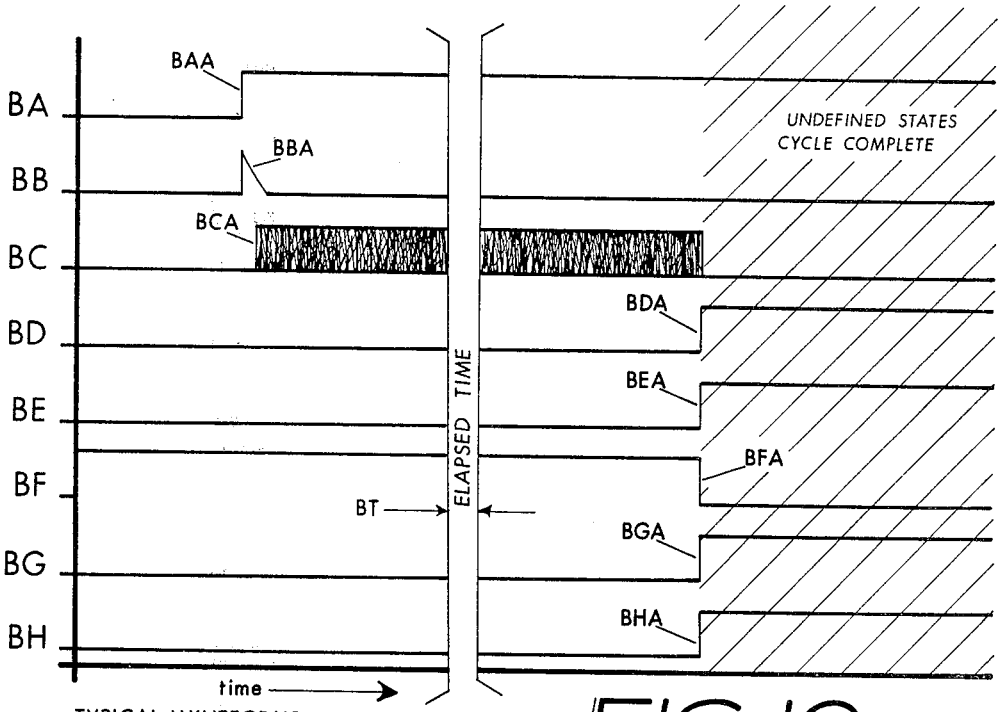

FIG. 10 Waveform representations for the circuit described in FIG. 9.

Figure 11:
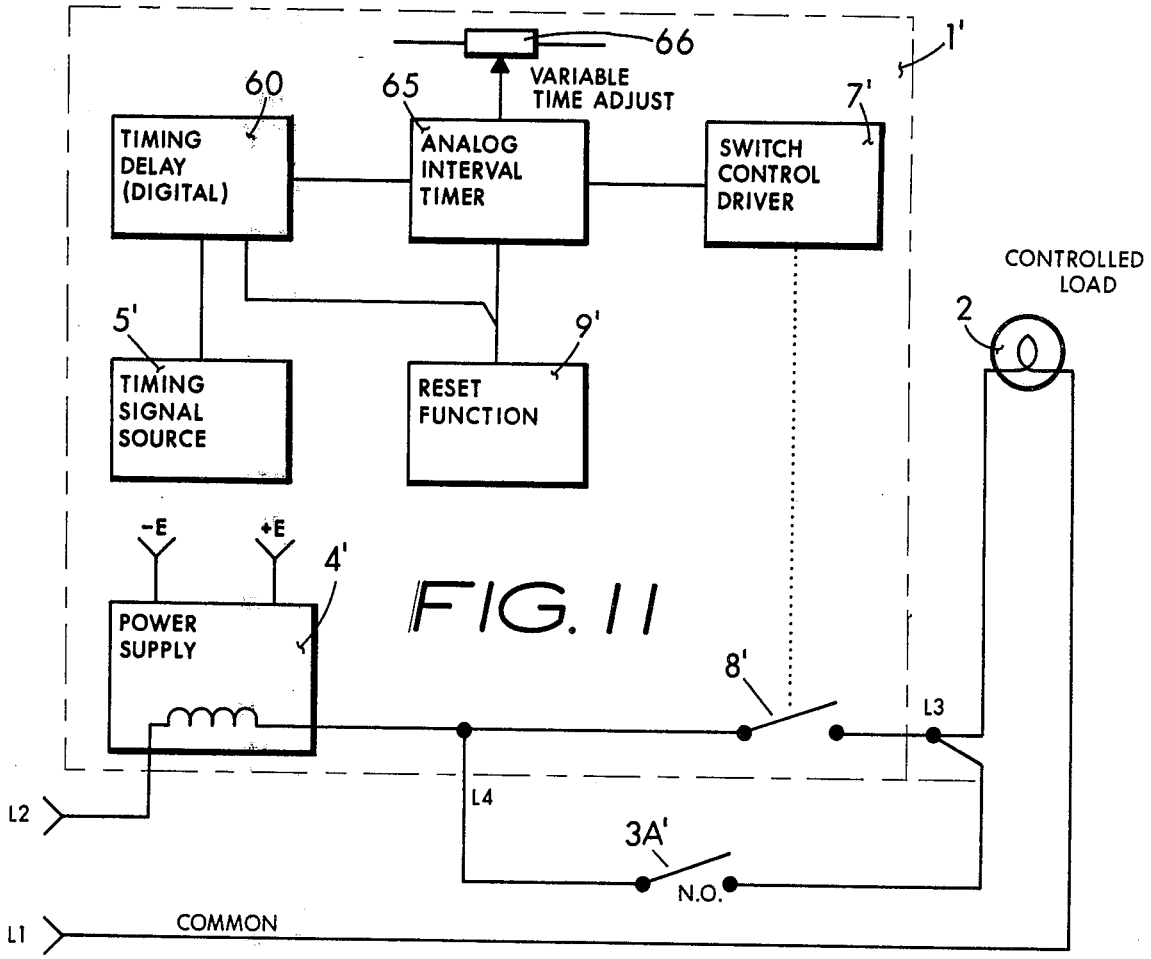

FIG. 11 Functional diagram showing the interrelationship of the several essential elements forming a combination of an analog timing element with the invention essence.

Figure 12:
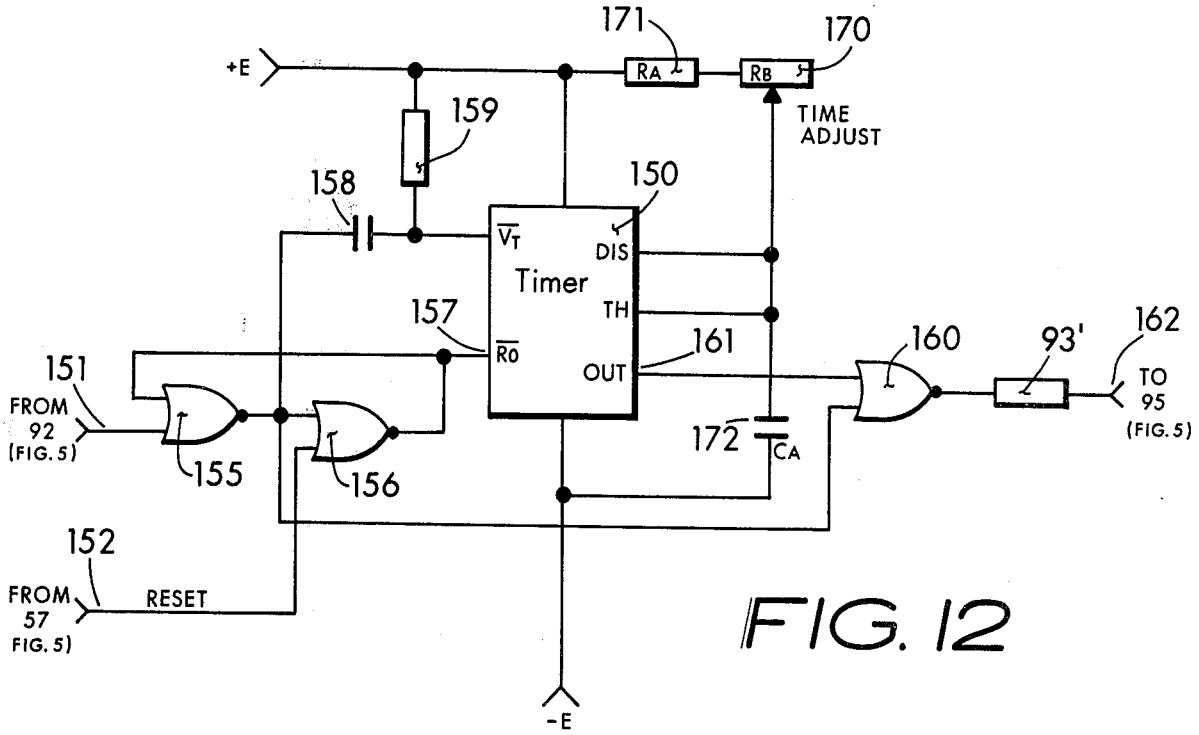

FIG. 12 Circuit detail operative with FIG. 5 to combine incremental analog delay with the step selected digital delay.

FIG. 13 Circuit detail operative with FIG. 9 so as to provide light activated control of the timer, as by daylight.

FIG. 14 Circuit detail operative with FIG. 5 so as to provide light activated control of the timer, as by daylight.

FIG. 15 Circuit detail operative with FIG. 5 so as to provide indirect magnetic field influence control of the switching function while retaining minimum current flow through the switch element.

DESCRIPTION OF INVENTION

The gist of the two-terminal timer is taught in FIG. 1. The expression two-terminal timer refers to an electrical control device which operates to act upon an electrical circuit after some finite time period has elapsed, and furthermore wherein such operation takes effect in only one side of a power circuit and derives power therefrom only when the said load timed state is "on". Usually the timer is installed in the HOT side of a circuit, and therefore no common or return is needed. This is of course basis for considerable improvement over any other known timer device employing electronic timing techniques, as the usual electronic timer requires the common, or neutral, for proper operation, or else draws substantial current via way of the load even when in the load timed "off" state if of the earlier "two wire" variety. The value in this is to be found in particular in the use of my invention in old construction, e.g. pre-existing buildings and the like, where no common or neutral may be available at the preferred timer switch location. This comes about because it is usual practice to simply run two wires to the usual wall toggle switch, etc. in commercial building practice, so as to save on wire cost and to some extent, labor. FIG. 1 shows a two terminal connection in that the timer 1 is connected to the hot side L2 of the line, whereas the common L1 side goes directly to the load 2 and therefore has no direct connection with the timer device. The artisian will quickly recognize that as a common and typical wiring installation in houses, stores, and other building types. No load current will flow until the switch 3 is briefly closed, whereupon current will flow from input terminal L2 to the load 2 via terminal L3. The current flow so produced will pass also through the input of a current energized power supply 4, exampled as the primary of a current transformer or the like. The result is that a d.c. value +E, −E will be produced which will serve to power the other circuit means which comprise the timer, in particular the timing signal source 5, the timing period gate 6, and the switch control driver 7. In addition, a brief reset signal will be produced by the reset function 9 which serves to initialize at least the timing signal source 5. The switch control driver 7 will immediately produce a switch drive signal which will effectively close switch 8, thereby serving to maintain circuit current flow from the primary source to the load even when the switch 3 once again opens. The timing signal source 5 will proceed to produce a delayed signal component which will act upon the period timing gate 6 after some time has elapsed as predetermined by the timing signal source 5. When the time period is up, the timing period gate 6 produces a signal which will act upon the switch control driver 7 in such a way as to negate the holding action produced in the switch device 8. Thus current flow to the load 2 via line L3 will cease. In a typical form for my invention, a brief closure of but a fraction of a second for switch 3 as produced for example by finger depression of a momentary contact switch 3 arrangement will serve to initiate the aforesaid circuit action. The time period which ensues, while usually pre-established as a particular value or range of values, will in the typical timer produce a timing period which lasts at least several minutes. The artisian will of course realize that my invention finds application for any imaginable time period from merely a few seconds or less to that of hours, days, or even longer. Furthermore the load 2, while shown as a lamp load, may of course be any sort of electrically driven load as for example, a heating device, motor, transformer, or the like.

The hookup of my novel timer as the replacement for a regular switch is shown in FIG. 2. The leads 10A from the usual terminals 12, 13 on a lighting device 2A or the like are transferred from the removed regular switch 14, e.g. the common wall toggle switch or such, leads 10B and instead connect to the new TIMED SWITCH 1 input L2 and output L3. Common line L1 connects to the light 2A terminal 11, whilst input L2 connects through terminal 13 to switch input L2. The result is a "DELAYED OFF" function, initiated by a momentary contact switch which forms part of the timer as depicted earlier in FIG. 1.

The circuit form for one preferred embodiment is depicted in FIG. 3. No load current flows until the momentary switch 3A, when briefly closed, initiates current flow between the input terminal L2 and the load 2 via output terminal L3. Transformer 15 connects in series with this current flow and, therefore, a voltage is determined in the secondary in accord with the well understood action of a pair of magnetically coupled coils. The transformer 15 secondary voltage, which is de-spiked by the action of capacitor 54, couples to a rectifier arrangement including diodes 16A, 16B, 16C, 16D. The rectifier output on line AA is a pulsating d.c. value, the frequency of which is:

$$F_p = 2F_L$$

where:

$F_p$=pulsating d.c. frequency; and, $F_L$=input line frequency.

With common 60 hertz (50 hertz) utility power input, the pulsating d.c. frequency $F_p$ will be 120 hertz (100 hertz), or said another way, the period will be:

$$T_p = 1/F_p$$

where: $T_p$=pulsating d.c. interpulse time period (seconds). Again this becomes 8.33 milliseconds (10 milliseconds) for 60 hertz (50 hertz) utility power.

This pulsating d.c. value $F_p$, better depicted as waveform AA in FIG. 4, couples by way of a resistor 21 to the base of a NPN transistor 20. The result is a pulsating clock rate frequency in the collector thereof, across load resistor 22, which is a waveform AB of improved rise time as applied to the CLOCK input 23 of a divide-by-two connected J–K flip-flop 24. The output 25 is 60 hertz (50 hertz) which couples to the input of a second divide-by-two flip-flop 26. The resultant 30 hertz (25 hertz) output 27 produces a timing waveform AC which feeds the $\overline{\text{CLOCK}}$ input of the divide-by- $2^{14}$ counter 30, for example a R.C.A. type CD-4020 C-MOS binary counter or the like. The result is a plurality of outputs which may be selected by way of jumper connection (or switch) 31 so as to produce a variety of timing waveforms AD as coupled to PNP transistor 32 by way of resistor 33. With the exampled CD-4020 integrated circuit counter 30, the following time increments may be expected as the resultant timer cycle:

| Jumper 31 connected to counter 30 output: | Elapsed Time | |
|---|---|---|
| | 60 hertz | 50 hertz |
| Q4 | 0.267 second | 0.320 second |
| Q5 | 0.533 second | 0.640 second |
| Q6 | 1.067 seconds | 1.280 seconds |
| Q7 | 2.133 seconds | 2.560 seconds |
| Q8 | 4.267 seconds | 5.120 seconds |
| Q9 | 8.533 seconds | 10.240 seconds |
| Q10 | 17.067 seconds | 20.480 seconds |
| Q11 | 34.133 seconds | 40.960 seconds |

-continued

| Jumper 31 connected to counter 30 output: | Elapsed Time 60 hertz | 50 hertz |
|---|---|---|
| Q12 | 1.138 minutes | 1.365 minutes |
| Q13 | 2.276 minutes | 2.730 minutes |
| Q14 | 4.551 minutes | 5.460 minutes |

It is necessary to understand the operation prior to the time cycle completion. When power is first applied, as produced by current flow between L2 and L3 through the transformer 15, a d.c. voltage will develop across the capacitor 19 by way of steering diode 18. This produces an operating d.c. value +Vc for the circuits on line 50. This rapid rise in $+V_c$ value couples through capacitor 52 to the reset $R_0$ input on counter 30; however the reset quickly returns to near ground by the discharge action of resistor 51. The result is a reset pulse a few milliseconds (or less) in duration will serve to reset the counter state outputs to all zeros (logic "0" or LOW). Accordingly the LOW output on line 31 will serve to turn-on PNP transistor 32, effectively saturating the device with the result that the collector thereof will be near the $+V_c$ value as shown in waveform AE. This value couples to the base of NPN transistor 35 through resistor 36, in turn saturating the transistor and resultingly drawing the collector value across load resistor 39 as appearing at connection AF near to ground level. This will cause the unilateral conductive device, or diode 38 to conduct, with the result that PNP transistor 37 will be properly forward biased into an ON state. In the shown hookup, the emitter and base of transistor 37 will be properly forward biased into an ON state. In the shown hookup, the emitter and base of transistor 37 are NOT supplied from the $+V_c$ line, but rather from the source of 120 hertz (100 hertz) pulsating d.c., albeit positive in sign. The effect is that when the PNP transistor 37 is turned on through diode 38, the collector current through resistor 46 and therefore as coupled to the gate of thyristor 45 (a TRIAC in the example) will pulsate in accord with the 120 hertz (100 hertz) rate as shown in waveform AG.

When the counter 30 output state on the selected line reaches the desired count and goes logic "1" or HIGH, the transistor 32 will turn-off. The result is that the transistors 35 and 37 will accordingly turn-off and the thyristor 45 will commutate on the next half-cycle zero crossing in accord with well known practice. In the shown hookup, the timing period is equal to:

$$T_t=(1/F_{AC})(2^{Qn-1})$$

where:

$T_t$=timing period in seconds;

$F_{AC}$=clock input waveform a.c. frequency on counter 30; and

Qn=selected Q line output on counter 30.

The output timing function for FIG. 3 appears as waveform AH in FIG. 4. The elapsed times for the waveforms of FIG. 4 are shown as interval AT. It will also be apparent that the control actions all occur on clock pulse ABA edges ABB, referring to edges ACA, ACB, ADA, AEA, AFA, AGA, AGB, and AHA. The time period for the clock pulse appears as AAA, being $2F_L$ as previously defined.

Yet another timer offering some improvement over the aforesaid circuit of FIG. 3 appears in FIG. 5. Two particular merits for this new circuit include:

a. independence from load current variation as an effect on +Vc value; and, b. time increments in decimal value.

The circuit of FIG. 5 dispenses with the current transformer of FIG. 3 and instead uses the novelty of a d.c. power supply for +Vc which is virtually indedpendent of any reasonable change in load 2 value; the maximum value being that set by the power handling capability of the power passing semiconductors, e.g. thyristors 45, 70 and diode 71. The operation of the d.c. power supply is fully published in U.S. Pat. No. 4,300,090 issued Nov. 10, 1981, "Direct Current Power Supply" to which the artisian is referred.

Circuit operation is initiated by a momentary connection, as by a push switch or the like, between external control line L4 and the controlled line L3. The resultant current flow to the load will flow through the components of the d.c. power supply including thyristor 70 and diode 71 with the result that when input L2 is negative relative to common L1, diode 71 will pass current; whilst in the opposite mode when input L2 is positive relative to common L1, the thyristor 70 will INHIBIT current flow until zener diode 72 conducts drawing current through resistor 73 and the thyristor 70 gate.

The brief period during each half-cycle prior to the turn-on of the silicon controlled rectifier 70 results in a recurring unipolarity pulse between the thyristor anode and cathode which is coupled by a unilateral conductive device, or diode 74, to an accumulator, e.g. capacitor 75. The result is a d.c. value +Vc is developed across the capacitor 75 which powers the circuit elements. What is important is that the value of the unidirectional pulse is fully independent of the LOAD current when that current is above a minimum value of but a few watts, due to the action of the zener diode solely responding to the power input waveform voltage magnitude component.

The increase in +Vc d.c. value, when first turned on, is delayed in application to the inputs of NAND gate 87 and inverter 57 by the integration effect of resistor 56 having to charge capacitor 55 first. This results in a logic "1" or HIGH at the inverter 57 and gate 87 outputs as coupled to the respective counter 90 and counter 85 reset $R_0$ inputs.

This timely action results in the resetting of the counters to zero state. The clock rate is provided from the connection 82 which contains a fundamental pulsating d.c. component (due to the action of the aforesaid thyristor 70) at the line source frequency $F_L$; e.g. 60 (50) hertz. The resultant pulses couple through resistor 81 into two cascade inverters 80, 83 for waveshape enhancement prior to coupling to counter 85, say C-MOS type CD-4040, which operates in the shown configuration as a divide-by-3,600 function together with decode NAND gate 86 feeding back to the reset $R_0$ line through NAND gate 87. The result is a series of one-minute ticks, or clock pulses, coupled to CK input 89 on counter 90. While I describe 60 hertz operation, decoding instruction changes to produce a divide-by-3,000 action in counter 85 will allow 50 hertz operation; other combinations being equally obvious to the experienced practitioner.

Counter 90 is exampled as the widely used C-MOS type CD-4017 counter-decoder. The counter, $R_0$ input 58 having been reset, rests with all outputs 1 through 9 at a logic LOW value. Output 0 is logic HIGH, and therefore is invalid as a function. The nine outputs 1 through 9 are, accordingly, coupled to a selector switch 91 (or else jumpers are used). Line 0 is also shown connected: the result is either the mechanical rotation stops on the switch prevent selection of position "0"; or else this position serves as a timer over-ride function, which is to say that the controlled load 2 is ON only for so long as the external closure between line connections L3 and L4 exists, but no time delay function ensues.

As long as the switch 91 rotor connection 92 is logic LOW, PNP transistor 95 is forward biased through resistor 93, causing substantial collector current flow through resistor 46 and thus the gate of triac 45 including gate shunt resistor 47. The result is the triac 45 is turned ON, thereby serving the load 2. The OFF signal occurs when the time function completes:

$$T_t=(1/F_L)(M\cdot D_n) \text{ seconds;}$$

where:

M=effective division factor of counter 85; and, $D_n$=division factor of counter 90 output as selected by switch 91.

When the desired count is reached, the rotor 92 line goes to a logic HIGH state: e.g., PNP transistor 95 is shut off. The controlled load 2 is subsequently disconnected, current flow in line L3 ceases and the result is current between terminals L2 and L3 ceases. The timer is thereby disabled.

The hookup for a lamp load 2A having remote OFF action in conjunction with the new timed switch appears in FIG. 6A. What is provided is:

1. The circuit is turned ON at the timed switch 1 by the action of momentary switch 3 (FIG. 1); and, 2. The circuit may be turned OFF prematurely (i.e., before the time cycle completes) by a separate momentary normally closed switch 100 usually connected between the line L3 timer output and the load L5 line.

FIG. 6B depicts some variation, in that two or more switches 101, 102 are shown, whereby any one switch may be momentarily opened, resulting in the premature interruption of the circuit current flow.

The hookup for a lamp load 2A having remote ON action in conjunction with the new timed switch appears in FIG. 7. What is provided is:

1. The circuit is turned ON at the timed switch 1 by the action of momentary switch 3 (FIG. 1); and, 2. The circuit is also able to be turned ON at any one of several remote locations by the momentary action of any remote normally open switch 105, 106.

The hookup for an arrangement providing for either remote ON or remote OFF control by several remote switch locations appears in FIG. 8A. The ON state is initiated by any one normally open momentary action switch 105A, 106A as explained for FIG. 7, whilst the OFF state is accomplished by any one normally closed momentary action switch 101A, 102A as explained for FIG. 6B.

The hookup variation depicted in FIG. 8B accordingly shows but one remote switch position.

While I have described the invention in terms of a digitally programmed timer: the essence of my invention, being that of a two terminal timer, can be implemented with analog timing techniques. FIG. 11 gives illustration of my teaching using an analog interval timer 65 as a timing element having a continuous variable time adjustment 66. My preferred embodiment also employs a digital timing delay function 60 for course preset delay, bringing the analog delay into play for incremental adjustment. The circuit depicted in FIG. 12, together with the circuit described earlier for FIG. 5 best shows my teaching. Through connecting the rotor 92 of switch 91 to the input 151 of NOR gate 155 instead of to resistor 93, the analog delay will serve to complement the decimal-step delays produced by the circuit of FIG. 5. The reset signal produced by gate 57 couples 152 to NOR gate 156 serving to initialize the circuit upon turn-on so the latch effected by cross coupled gates 155, 156 will be reset with gate 156 output 157 logic LOW to the $\overline{R_0}$ input of timer 150 which is exampled as a C-MOS device, for this illustration an Intersil type ICM-7555 or the like. When the digital timer logic HIGH state occurs on input 151, the latch will be reset and timer 150 input $\overline{R_0}$ will go logic HIGH, serving to enable the analog timer 150. At the same time the sudden change to logic LOW at the output of gate 155 will produce a differentiated trigger pulse for the $\overline{V_T}$ input of the timer 150. The analog timer will then progress through its pre-established time cycle period as defined by the effective value of timing resistances 170, 171 together with capacitor 172 as coupled to the discharge (DIS) and threshold (TH) inputs of the timer device in a manner well known in the so-called "555" family of integrated circuit timers. The delay accordingly becomes:

$$T_{AD}=(R_A+R_{Beff})C_A \text{ seconds;}$$

where:

$R_A$=resistor 171 in megohms;

$R_{Beff}$=effective value of potentiometer 170 in megohms; and, $C_A$=capacitor 172 in micorfarads;

which upon completion produces a logic LOW state at the output 161 as coupled to NOR gate 160. The NOR gate 160 is satisfied with both inputs LOW so as to produce a logic HIGH output on the line which couples to resistor 93' and in turn connects 162 to transistor 95 in FIG. 5 thereby serving to satisfy the circuit conditions for FIG. 5. With the circuit of FIG. 5, one minute steps are produced by the selection established by switch 91. Therefore if the analog timer 150 nominal component selections allow for about a one minute analog delay, the result will be a nice arrangement wherein the switch 91 selects the one minute steps whilst the analog time adjustment 170 affords a goodly fill in of time increments with nearly infinite resolution. The best practice of the combination is to establish the $R_A$, $R_B$ values to permit analog adjustment between about one minute and two minutes: viz, a 2:1 range. Under this condition the effective overal time delay sequence values become equivalent to:

$$T_{BD}=T_t+T_{AT};$$

or for the cited example:

$$T_{BDmin}=T_t+60 \text{ seconds; and,}$$

$$T_{BDmax}=T+120 \text{ seconds;}$$

where:

$T_{BD}$=effective overall time period of combined circuits of FIG. 5 and FIG. 12; and, $T_{AT}$=analog timer delay value;

thus providing for the quasi-infinite setting of incremental time delays for producing an overall time related event signal which is substantially the sum of the selected digital time delay $T_t$ and the incremental analog time delay $T_{AT}$.

The introduction of a light detector in combination with my teachings of FIG. 9 is shown in FIG. 13. In this hookup, the timing action does not commence until two conditions are met:

1. The input lines L1, L2 are switched ON; and,
2. The photoreceptor 180 is darkened, as by night time conditions, for example.

When these criteria are effected, the timer will commence the delay cycle and turn-on the load after the predefined finite delay has elapsed. With a.c. power applied, operation is such that when the photocell 180, for example a cadium sulfide photocell or the like, is illuminated as by daylight the resistance across the cell will diminish to a low value. This value will be a few thousand ohms or less. In the particular model I describe, a suitable photocell can be found in the model VT841L manufactured by Vactec, Inc. This action will cause the $+V_c$ value 114 to be coupled through the low cell resistance, through diode 181, and serve to develop a substantial positive value at the junction with resistor 77A, which is usually on the order of at least several times the photocell's illuminated resistance value, e.g. several thousand ohms. In fact it is the value of resistor 77A relative to that of the resistance value of the photocell at a particular illumination level which establishes the transistion state in the typical "daylight-to-dusk" application. The aforesaid positive value serves to reset at least the counters 125, 130 and flip-flop 133. When the darkness value occurs, the reset voltage developed across 77A will decrease to the value where counter 125, 130 can proceed cyclically through the count period and, in due course, turn on the load after a delay. The reset capacitor 78A corresponds with the purpose of the earlier element 78, whilst diode 182 decouples the substantially independent reset roles of the capacitor 78A and the photocell 180.

Yet another variant configuration is shown in FIG. 14, which cooperates with FIG. 5 to produce a time function which turns ON at dark and then turns OFF after a finite delay. In this mode, if lines L1, L2 have power applied, the illuminated resistance value of the photocell 180 will decrease the value as coupled from the juncture with resistor 184 to NAND gate 190 to a LOW state value. The result is the gate 190 output as coupled to the transistor 95 base will be HIGH, e.g. the transistor will be biased OFF and the result is no thyristor 45 gate current resulting in a load 2 OFF condition.

The photocell LOW value also couples to NAND gates 57A and 87A, thereby serving to reset counters 85, 90. When photocell darkness occurs, the value at the juncture with resistor 184 will rise to an effectively HIGH logic state as coupled to gates 57A, 87A, 190. With counter 90 effectively reset, the value on the switch rotor 92 will be LOW, being inverted 191 and coupled to gate 190. The gate 190 will thereupon be enabled, pulling the output LOW and thereby turning ON transistor 95 resulting in the turn-on of the thyristor 45. The load will remain connected until the timing element output from rotor 92 goes to a HIGH state, whereupon the double inverted value on the base of transistor 95 will go high resulting in load shut-off after a finite delay. The ratio between the dynamic resistance value of the photocell 180 and the load resistor 184 serves to determine the switch-over threshold, i.e. the "dusk" setting.

In environmentally hostile applications, the use of mechanical switch elements for actuation of the timer can be expected to lead to problems of service lifetime and reliability. Such conditions are frequently encountered, as for example where outdoors applications are contemplated, or in chemically active atmospheres. Furthermore unprotected mechanical switch elements are unacceptable in explosive environments, such as refineries, coal mines, and the like. In FIG. 15 the circuit refinements are shown, giving improvement over earlier FIG. 5, which allow the use of a magnet actuator 196 acting upon a magnetically responsive switch element 195 such as a reed switch. Connection of the switch is in the thyristor 45 gate element circuit, resulting in a small current flow requirement for the switch 195 and the gate resistor 197. If the switch is of the normally open type, moving the magnet into proximal relationship therewith will result in circuit turn-on. In the preferred embodiment, the switch element 195, along with the timer circuit elements, is encapsulated in an environmentally impervious plastic material such as epoxy resin. Thereupon the switch action is brought about by presenting the magnet 196 field lines to the so produced module in such an effective way as to activate the switch element 196. This movement of the magnet structure is preferably operator controlled as the extension of a mechanisim which is comprised of inert materials such as stainless steel, plastic, or the like which will afford a high degree of corrosion resistance.

Even though the teaching uses a magnetically activated reed switch, the artisian will find it well within his skills to apply a Hall effect device, or other magnetically responsive means. Furthermore, using the teaching of FIG. 14, if the photocell 180 views a permanently ON light source, such as an L.E.D. or neon lamp, the switch action can be accomplished in a useful way by means of a shutter-like mechanisim between the source and the photocell with the shutter being operable so as to selectively inhibit or else translate light energy between the source and the photocell. The practitioner will quickly recognize the ability of this coupling mechanisim to provide an environmentally resistive improvement for the basic teachings central to this invention, for in the example of an explosive environment, the light coupled between the light source and the photocell has been demonstrated coupleable by way of a fibre-optics means. This results in the electrical parts of the circuit being locatable in a safe area, whilst only the fibre-optics enters the explosive area with, of course, an operable shutter or the like serving to control the coupling efficiency between the light source and the photocell.

While a variety of preferred embodiments have been described, each of which satisfy somewhat different application for my invention, the novel essence of my teaching is to be strictly found in the two terminal connection provided by my invention which draws no current by way of the load circuit coupled thereto when in the load timed "off" state.

Although I have elected to show particular parts values and time measure for my teaching, this is by way of achieving a better understanding of my invention by an artisian and therefore shall not serve to restrict my invention from any combination of elements which might serve to satisfy the basis for my invention: that of a two terminal timer.

Even though the diagrams included with this description depict the common, or return circuit connection, this is for completeness of understanding and the wary artisian will appreciate that the timer does not include direct connection thereto in order to satisfy the timing function.

The particular time delay values are described to give the description credibility. The choice of almost any delay amount, from that of a fraction of a second, to a value of hours, days, or even longer is entirely within the scope of my invention and can be accomplished by merely making adjustments as to the circuit hookup, for example the binary counter connections, and like trivial implementation detail.

What I claim is:

1. Two terminal timed switch device which serves to substantially connect into but one side of an electric power circuit from which all operative power is therefrom derived for operation of the time control functions through utilization of the effects of current flow through the said device during the timing period "on" state; said timed switch substantially including:

a. a source of electric a.c. power;

b. an a.c. load means;

c. at least two conductive elements coupled between the said source and said load, wherein the said elements form substantially a first electric circuit path and a second electric circuit path for the effective flow of electric energy between the said source and said load;

d. controlled switch element means coupled effectively in series with at least one of the conductive element electric circuit paths so as to alterably effect a condition of maximum electric current flow therethrough during the timing period and negligible electric current flow therethrough upon cessation of the said timing period;

e. control means coupled to said switch element means and cooperative therewith so as to establish the instantaneous condition of electric current flow therethrough;

f. time delay means including a combination of electronic semiconductor circuit means, effective so as to provide a time related event signal which couples to the said control means;

g. power supply means, the output of which is coupled to at least the said control means and said time delay means so as to effect the operation thereof; importantly having but two essential input terminals thereto; said input terminals further being coupled in series with but one said electric circuit path between the said source and said a.c. load and operative to receive power therefrom during the period of maximum current flow, whereas negligible, substantially zero power flow occurs once the timing period is complete; and, h. initiating means coupled effectively at least in parallel with said switch element means and effectively in series with said power supply means and operative to produce at least a momentary flow of current through the electric circuit path between the said source and said load and to thereby effect the control means to establish current flow through the controlled switch element means for a finite period of time until the said time related event signal occurs, whereupon the current flow through the controlled switch element ceases.

2. Device of claim 1 wherein more particularly the said controlled switch element means includes a thyristor, exemplified as a silicon controlled rectifier or triac, coupled substantially in series with one of the said conductive element electric circuit paths and cooperative therewith so as to regulate the value of current flow through the said circuit path in response to signals coupled to the said thyristor gate control element means from the said control means.

3. Device of claim 1 wherein more particularly the said time delay means includes a sequentiality of bistable logic circuit elements, effective at least in part as a binary counter serving to produce a time related event signal which is precisely derived from a continuum of clock pulse cycles, with each said cycle having a period expressly some integral value which is less than that of the said event signal overall time period.

4. Device of claim 1 wherein more particularly the said time delay means includes a sequentiality of bistable logic circuit elements, effective at least in part as a binary counter, so as to produce a time related event signal which is precisely devived from a continuum of clock pulse cycles, with each said cycle having a period which is derived from the inherent a.c. frequency component provided by the said source of a.c. power.

5. Device of claim 1 wherein more particularly the said time delay means includes a sequentiality of bistable logic circuit elements, effective at least in part as a binary counter, so as to produce a time related event signal which is precisely derived from a continuum of clock pulse cycles, with each said cycle having a period which is effectively determined by a mechanical resonant device having individual cycle periods each of which is expressly less than that of the said event signal overall time period.

6. Device of claim 1 wherein more particularly the said time delay means includes a level responsive switching circuit means which effects a time related event signal therefrom as a result of the value of electric charge accumulated in a charge retention device having reached a predeterminate magnitude, in a prescribed time interval, as effected by the controlled flow of current through a circuit combination including the retention device, by way of a current flow restrictor.

7. Device of claim 1 wherein the said time delay means includes a multitudinous selection of time related event signals, providing varietal couplement options with the said control means, resulting in a said device providing flexability in the choice of time delay values.

8. Device of claim 1 wherein the said time delay means includes a digital, e.g. binary, interval delay means, as for example a counter, which serves to provide steps of selectable values of time delay.

9. Device of claim 1 wherein the said time delay means includes a digital, e.g. binary, interval delay means, as for example a counter, which serves to provide steps of selectable values of time delay and wherein further the said selected digital time delay serves to couple to the enabling input of an analog time delay element, e.g. a one-shot flip-flop or the like, which includes an adjustment which allows for the quasi-infinite setting of incremental time delays for producing a time related event signal which is substantially the sum of the selected digital time delay and the incremental analog time delay.

10. Device of claim 1 wherein more particularly the said power supply means includes a current responsive transformer, including at least a primary portion and a secondary portion, wherein the said primary portion is effectively coupled in series with but one of the said conductive elements and responsive therewith to produce a resulting magnetic coupling into the said secondary portion, as a result of current flow between the said a.c. power source and the a.c. load through the conductive element coupling, thereby setting up an a.c. potential value in the said secondary portion which is at least rectified and filtered and employed as a source of d.c. potential for the operation of the several semiconductor elements which serve to make up some part of the several function means which comprise the said timed switch.

11. Device of claim 1 wherein more particularly the said power supply means includes a thyristor device coupled effectively in series with but one of the said conductive elements and is operative as an interrupter device which serves to effectively inhibit current flow through the said conductive element during a small percentage of at least one half-cycle of each a.c. power full-cycle waveform pair of alternate half-cycles, whereupon further when the said electric potential value developed across the thyristor due to current flow to the said load increases to a finite preconductive value, the said thyristor will be in effect turned-on to a state of maximal conductance resulting in a minimal electric potential value to be developed across the said thyristor; the purpose being to utilize the preconductive value of electric potential to charge an electric accumulator, usually by way of a unilateral conductive device, e.g. a diode or the like, so as to serve as a source of d.c. potential during the timing period for the operation of the several semiconductor elements which serve to make up some part of the several functions which comprise the said timed switch.

12. Device of claim 1 wherein more particularly the timed switch means function is initiated by the onset of maximum electric current flow between the said source of electric a.c. power and the said a.c. load as usually produced by the temporary closure of a mechanical switch means or the like connected substantially in parallel with the said controlled switch element means, yet effectively in series with the serial electric circuit path produced by the said power supply means said two essential input terminals and one of the conductive elements coupling the said source to the said a.c. load, the result of which is to establish conditions in the circuit functions of the device which will firstly initialize, then start a series of events which combine to produce a control function signal suited for continuing the condition of maximum current flow between the said source and said a.c. load even after the said mechanical switch means or the like is returned to a normally non-closed state, with said control function signal continuing for a finite period of time until the said time delay means produces a said time related event signal, the effect being that once the said event signal occurs, the electric circuit path condition between the said a.c. source and said a.c. load will relax to a condition of negligible electric current flow.

13. Device of claim 1 wherein at least a temporary connection is established through at least one of the conductive element circuit paths, so as to act substantially in parallel, e.g. as a shunt across, the said controlled switch element; whereby current flow is established between the said source and the said load firstly by the said temporary connection, which serves to also initiate the said time delay means function and thereby enable the said control means; and thereafter by the action of the said controlled switch element; wherein further such current flow continues either for a finite time period until a negating time related event signal occurs from the said time delay means or else the circuit, including any of the conductive elements coupled between the source and the load, is interrupted in an effective manner so as to cause the current flow between the source and the load to cease thereby allowing the time delay means and control means to reset.

14. Device of claim 1 wherein the said time delay means function commences when a connective circuit path is operably established, as by a switch or the like, between the said source and the said a.c. load by an operator; said time delay function is enabled so as to produce a time related event signal some finite time interval after said connective circuit path is made; wherein further substantial current flow between the said source and the said load by way of the connective circuit path is maintained in a state of operative maxima by the low on-state impedance of the said controlled switch element until such finite timing period interval has elapsed whereupon the said time related event signal occurs thereby effecting a state of maximum impedance through the said controlled switch element which produces a state of negligible current flow to be effected between the said a.c. source and said a.c. load.

15. Device of claim 1 wherein the time delay function is initiated by the movement of a magnet in proximal relationship with a magnetically responsive switch element, the result being that to afford the sealed protection of the timer elements from the effects of a hostile environment, wherein the main coupling between the actuation means, controlled by an outside force, and the timer control elements is by way of the presence or absence of the magnetic field lines produced by the said magnet.

16. Device of claim 1 wherein the time delay function is initiated by a light value signal provided by a photoresponsive element, thereby producing a timed switch control function which occurs some finite time after the light value passes through a predescribed bounding value.

17. Device of claim 1 wherein the electric control action is that of a delay interval before load shut-off, once effective conductive element paths are made between the said a.c. source and said a.c. load means.

18. Device of claim 1 wherein a tell-tale lamp gives indication that the time delay function is active.

* * * * *